United States Patent [19]

Frascaroli et al.

[11] Patent Number: 4,639,049

[45] Date of Patent: Jan. 27, 1987

[54] MODULAR FURNITURE

[75] Inventors: Francesco Frascaroli; Carlo Biondi, both of Bologna, Italy

[73] Assignee: C.O.M. Cooperativa Operai Metallurgici S.C.R.L., Bologna, Italy

[21] Appl. No.: 601,854

[22] Filed: Apr. 18, 1984

[30] Foreign Application Priority Data

Apr. 22, 1983 [IT] Italy ..... 4850/83[U]

[51] Int. Cl.[4] ..... A40B 45/00

[52] U.S. Cl. ..... 312/195; 108/64

[58] Field of Search ..... 312/111, 195, 194, 107, 312/209; 108/64

[56] References Cited

U.S. PATENT DOCUMENTS

| | | | |
|---|---|---|---|
| 2,296,782 | 9/1942 | Fischer et al. | 108/64 |
| 4,094,256 | 6/1978 | Holper et al. | 312/194 |
| 4,382,642 | 5/1983 | Burdick | 312/195 |
| 4,658,335 | 6/1979 | Belcastro | 108/64 |

FOREIGN PATENT DOCUMENTS

| | | | |
|---|---|---|---|
| 549739 | 8/1956 | Switzerland | 312/111 |

*Primary Examiner*—William E. Lyddane
*Assistant Examiner*—Joseph Falk
*Attorney, Agent, or Firm*—Fuller, House & Hohenfeldt

[57] ABSTRACT

The invention comprises functional and esthetically pleasing modular office furniture with integrated wire management. The modules include horizontal beam modules that can be rigidly connected longitudinally and laterally in configurations that suit work flow and office personnel requirements to the office space. The beam modules are supported by vertical support modules. Work surface modules are supported by the beam modules. The beam modules may also have suspended therefrom a variety of office items such as file cabinets and keyboard surfaces. The work surface modules are adapted to optionally receive service modules such as telephones, trays, and light stands. The combined furniture modules provide hidden but accessible passages for neatly and efficiently running electrical wires from the office outlets to the points of use.

17 Claims, 15 Drawing Figures

311
201
303
309
313
305
151'
310
57
51
315
301
153
200
151
XIV
50
1
59
5
3
7
9
11
13
15
17
V

MODULAR FURNITURE

BACKGROUND OF THE INVENTION

1. Field of the Invention

This invention pertains to furniture, and more particularly to modular office furniture.

2. Description of the Prior Art

After years of designing office furnishings and equipment on a purely functional basis, designers are discovering that using advanced technology does not necessarily result in maximum productivity. Rather, people are most productive when, in addition to using modern furniture and equipment, they are motivated by proper psychophysical conditions. Thus, the office functional aspect, although necessary, is not sufficient.

It is well known that human behavior is influenced by environmental conditions. Modern office designers must solve functional problems, but they also must create conditions that psychologically encourage worker productivity. This may be achieved by giving each worker a feeling of security and importance, both as an individual and as a member of the group to which he belongs.

The principal task of the furniture designer is to create a personal workplace or "habitat" that avoids uniformity and monotony. At the same time, the furniture must be flexible in order to assure maximum freedom in organizing a work area. In short, the furniture must be designed to adapt the workplace to the individual in any office space.

SUMMARY OF THE INVENTION

The office furniture of the present invention assures a very high degree of freedom in the placement of the furniture within,an office space. This is accomplished by designing and manufacturing the furniture components in a number of interchangeable and interconnectible modules. While offering all the advantages of modular construction, the furniture of the present invention also provides maximum independence for the working persons, both individually and collectively. To further enhance the phychological well being of the workers, the modules are esthetically pleasing.

In accordance with the present invention, the basic element of the modular construction is a structural beam member with integrated wire management. To suit both the work flow requirements and human factors, several beam members may be rigidly joined together longitudinally and/or laterally by suitable connectors to create the best arrangement possible to suit the circumstances at hand. The beam members include wireways for bringing electrical power and control wires to the point of use in an efficient and unobtrusive manner.

The beam members are supported by as many modular vertical supports as necessary. The vertical supports may be placed at almost any location under the beams. The vertical supports include a variety of attractive foot configurations that suit both the placement of the supports and esthetic requirements. The vertical supports are rigidly fastened to the beam members by sturdy and easy assembled modular yokes and brackets. The vertical supports include ducts for bringing the electrical power and control services from the room outlet to the horizontal beam members, thus eliminating wires dangling over the edges of the work surfaces.

The work surfaces are available in several modular sizes and shapes. They are designed to suit the beam configurations to which they are rigidly mounted by modular yokes and brackets. The work surface modules are manufactured in a variety of attractive materials, including wood, glass, and plastic laminate. To minimize the exposure of wiring to electrical equipment, the work surfaces contain conveniently located outlets for passing the wires from the beam members to the equipment.

The modular construction of the furniture of the present invention includes storage and file cabinets that are rigidly suspended from the beam members by modular suspension components. The cabinets may be placed at almost any convenient location along the beam members. They are manufactured in various sizes, shapes, and materials.

The office furniture of the present invention also includes numerous attractive modular accessories, such as data processing work stations, lazy susans, electrical service modules, light stands, telephone trays, and paper baskets. The modular construction of the furniture components allows great flexibility in combining the various components into the most attractive and functional configuration possible for the office space available. The rigidity of the beam members and other structural components assures that the furniture system provides stable and pleasing work stations. Further, the modular construction allows rapid and easy alteration to suit changing work and personnel requirements.

Other objects and advantages of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
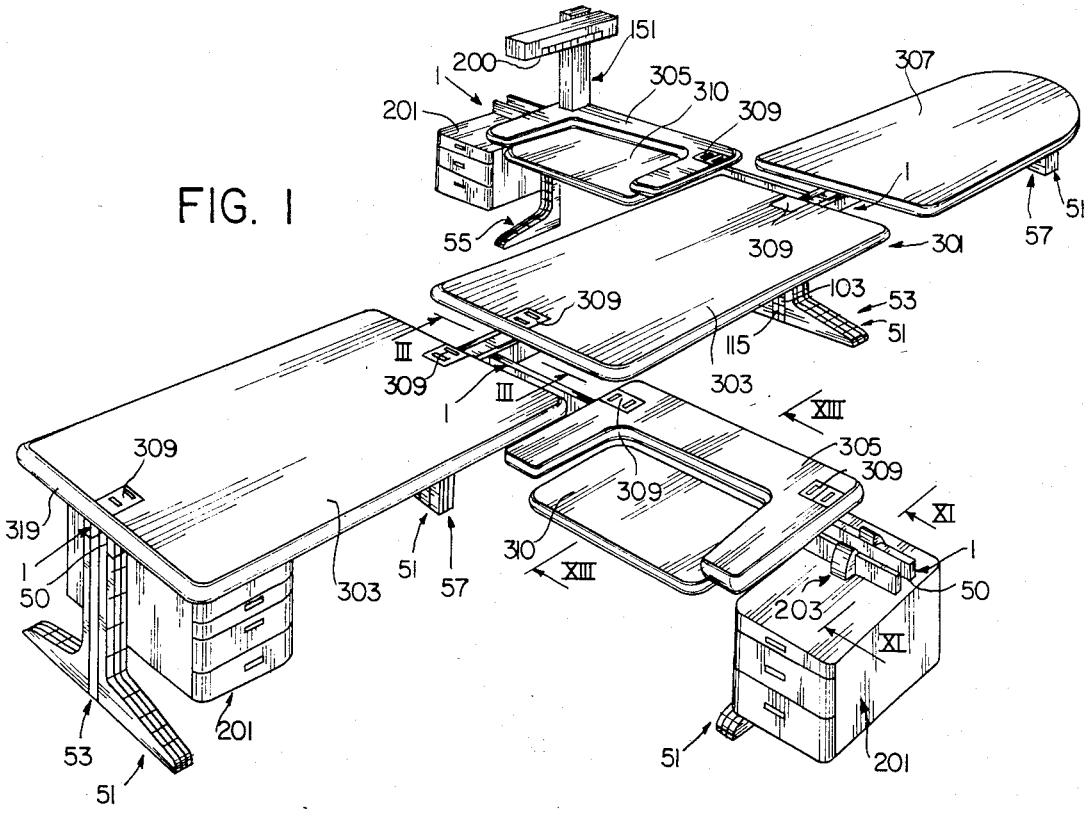
FIG. 1 is a partially exploded perspective view of a typical combination of modules of the office furniture of the present invention.

FIG. 1 shows one of an almost infinite number of combinations possible with the modules that comprise the office furniture of the present invention. The basic element of all module combinations is a generally horizontal beam member 1. The beam member serves as the fundamental structural unit that ties all the modules into a rigid and integrated assembly. The beam members may be curved or straight. As many beams as desired may be combined into straight, curved, and laterally connected sections. The versatility of the beam member placement allows maximum flexibility for designing a furniture configuration that both follows the work flow and that satisfies workers' environmental needs.

The beam members 1 are supported from the floor by a plurality of vertical supports 51. The vertical supports may be placed under and attached to the beam members at almost any location, thus complementing the flexibility of the beam members. Variations of the basic vertical support include the number and placement of the feet. For example, vertical supports 53 have two feet. Vertical support 55 has one foot, and vertical support 57 comprises merely a vertical support column without feet.

FIG. 1 illustrates six modular work surfaces 301 that may be rigidly connected to the beam members 1 at almost any convenient location. The work surfaces are designed in conjunction with the beam members to efficiently utilize the available office space while considering the psychological needs of the workers. In FIG. 1, the six work surfaces include four different modules; namely, two rectangular modules 303, two keyboard work surfaces 305, one round head work surface 307, and a keyboard surface 310 associated with each keyboard work surface 305. Although the work surfaces may be located in almost any location on the beam members, the edges of adjoining work surfaces normally abut. In FIG. 1, the work surfaces are shown with gaps therebetween for clarity, although it will be appreciated that non-abutting work surfaces are within the intention of the present invention.

Some work surface modules are adapted to receive a variety of functional and attractive service modules. For example, work surfaces 303 and 305 contain one or more identical openings into which an upstanding light module 151 or other module may be inserted. If a light or other module is not required, an attractive cover plate 309 is inserted into the work surface opening.

In addition to supporting the work surfaces 301, the beam members 1 may also carry one or more file or storage cabinets 201. The cabinets are rigidly suspended from the beam members by modular suspension mechanisms 203. Keyboard surfaces 310 are suspended from the beam members in a manner similar to the suspension of the file cabinets.

Figures 2, 4, 5:
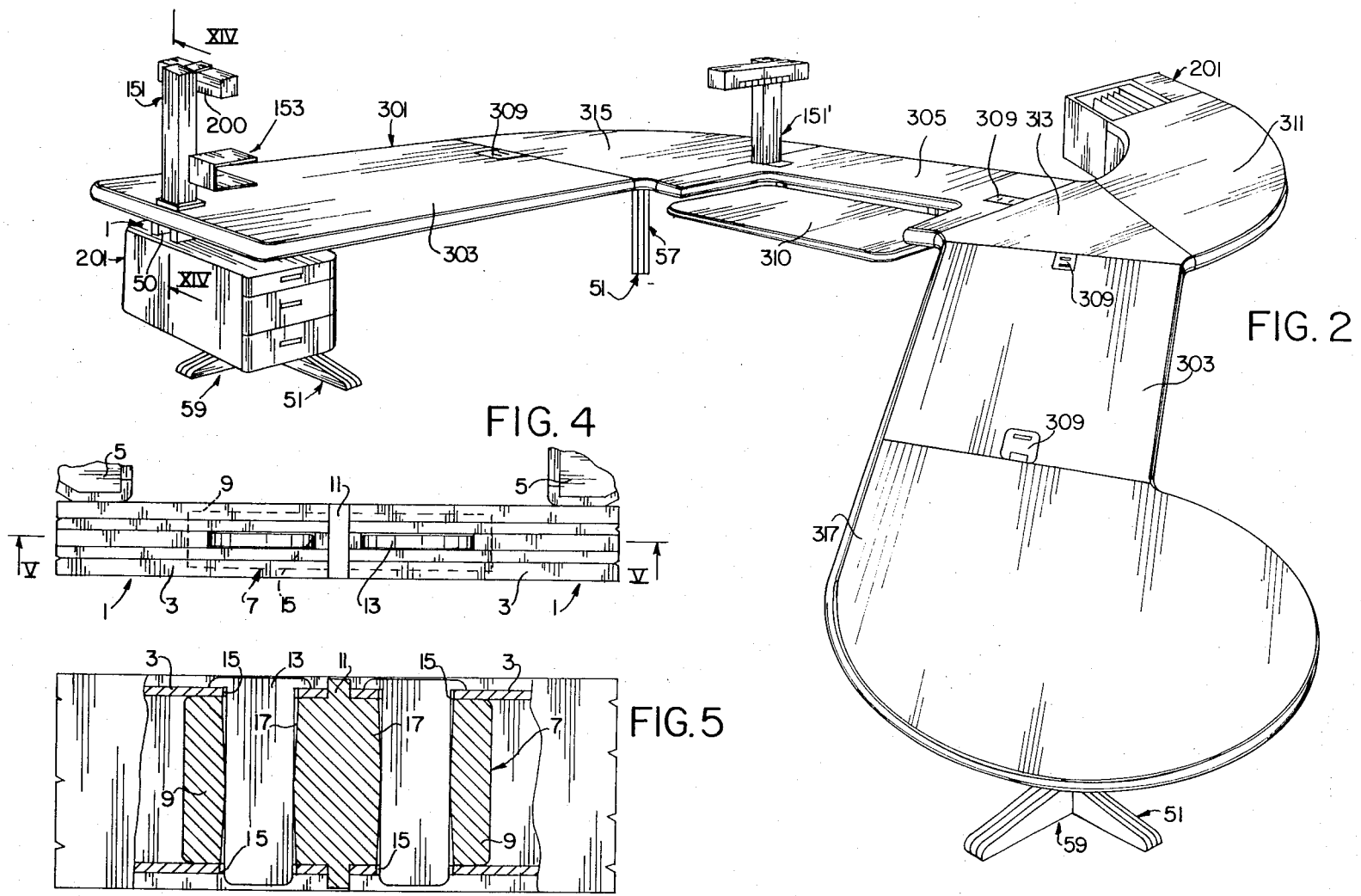
FIG. 2 is a perspective view of an alternate combination of furniture modules.
FIG. 4 is a top view of a longitudinal joint between two beams of the present invention.
FIG. 5 is a sectional view taken along lines 5—5 of FIG. 4.

FIG. 2 demonstrates the versatility of the modular furniture of the present invention. The beam members 1 underlie and support eight modular work surfaces 301. These include two rectangular work surfaces 303, a keyboard work surface 305, a semicircular work surface 311, a triangular wedge 313, a round wedge 315, a one-fourth circular work surface 317, and a keyboard surface 310. It will be noticed that the rectangular and keyboard work surfaces contain openings for service modules such as light modules 151 and 151', and the openings are covered by plates 309 if no service module is desired. Light module 151 supports a swingable telephone tray module 153.

In FIG. 2, two configurations of vertical supports are depicted. Vertical support 57 is a simple column. Vertical support 59 may include two, three, or four feet. One file cabinet 201 is shown in FIG. 2; it is suspended from the beam members by a suspension mechanism, not shown.

Beam Members

Figure 3:
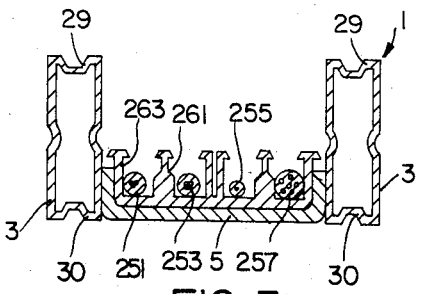
FIG. 3 is a sectional view taken along lines 3—3 of FIG. 1.

Turning now to FIG. 3, the construction of the modular beam members 1 will be described. Each beam member comprises a pair of parallel generally rectangular tubular beams 3 separated by and joined to generally U-shaped plates 5. The beams 3 may be straight or curved. Preferably, the plates 5 are much shorter than the beams 3, so two or more plates are normally used with each pair of beams. In the illustrated embodiment, the beams are fabricated with depressions 29 and 30 in the top and bottom walls, respectively. The preferred material for the beams and plates is steel, so the plates are typically welded to the beams. It will be noticed in FIG. 3 that the depth of the beams is relatively great in comparison to the width. That feature, together with the relatively thin-walled tubular construction, combines great bending stiffness in the vertical plane with light weight, thus contributing to the rigidity and versatility of the total assembly.

The joining of two beam members 1 is illustrated in FIGS. 4 and 5. Only one tubular beam 3 of each adjoining beam member is shown, because both beams 3 are joined in the same fashion. A connector 7 has an opposed pair of four-sided tongues 9 that fit closely within the interior of the beams. The tongues extend from a central base 11 having a periphery that generally corresponds to the external dimensions of the beams. To connect two beam members longitudinally, the tongues of connector 7 are inserted into adjoining beams, and the beams are drawn together until their ends strike opposite sides of the base 11. To securely lock the beams to the connector, a headed key 13 is inserted through a slotted opening 15 in the top and bottom walls of each beam and a corresponding slot 17 in the tongues. The slots 17 taper inwardly from the opposite surfaces of the tongue. The tapers aid in creating a strong and rigid joint between adjoining beam members. To disassemble a joint for modifying a combination of beam members, it is necessary merely to remove keys 13 and pull the beams apart from connectors 7.

Figure 7:
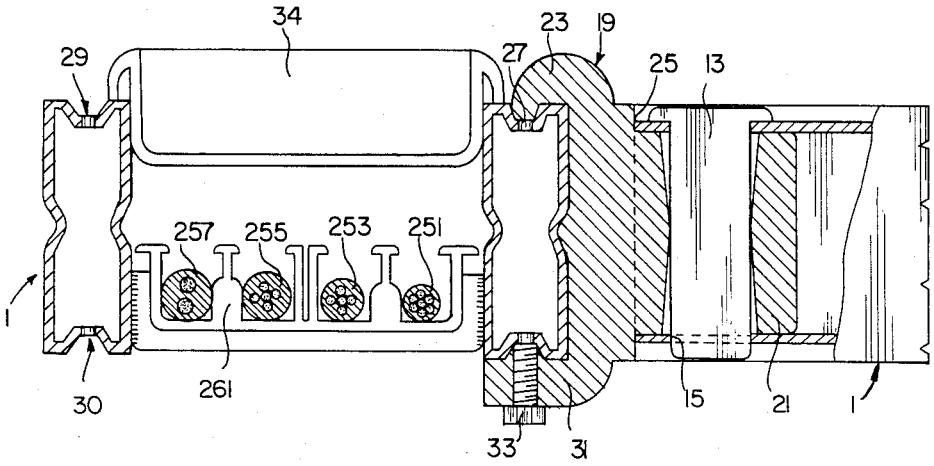
FIG. 7 is a sectional view taken along lines 7—7 of FIG. 6.
Figure 6:
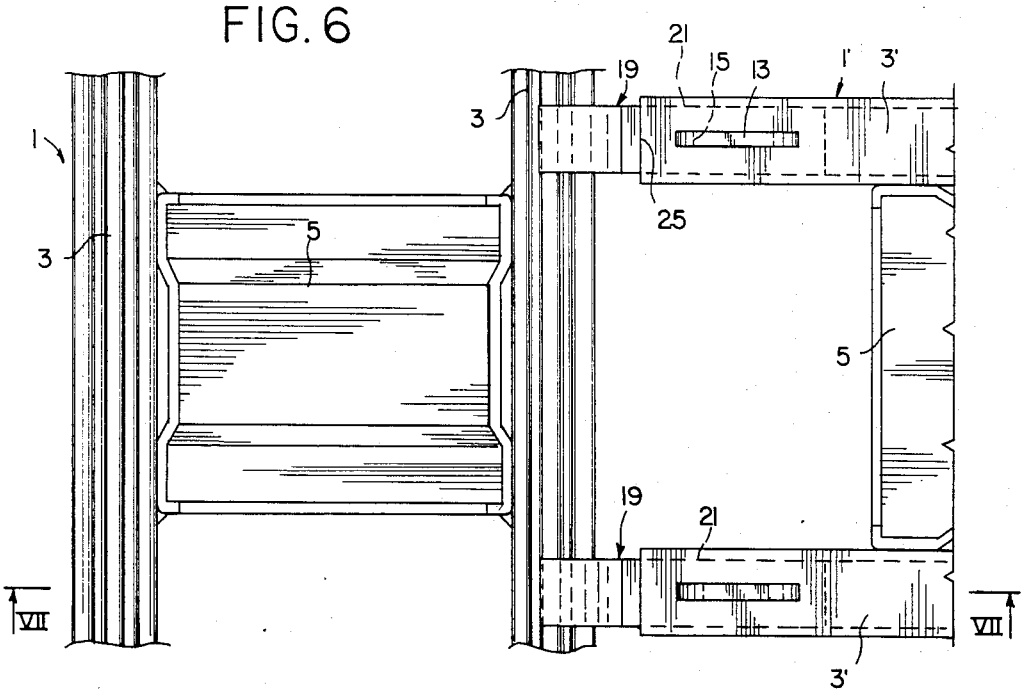
FIG. 6 is a top view of a lateral joint between two modular beam members.

FIGS. 6 and 7 disclose the lateral joining of two beam members 1 and 1' at 90°. Two angle clamps 19, each having a tongue 21 and a jaw 23, are employed to rigidly join beam member 1' to beam member 1 at almost any desired location along the length of beam member 1. The tongues 21 are inserted into the interiors of the beams 3' until the ends of the beams strike angle clamp shoulders 25. Keys 13 are employed to rigidly lock the angle clamps in the beams 3', as previously described for the longitudinal connectors 7. To secure the angle clamps and beam member 1' to beam member 1, each jaw 23 is provided with a hook 27 for mating with beam top depression 29 and a foot 31 opposite the hook 27.

Each foot contains a threaded opening into which a screw 33 is threaded. The screw is sized to fit beam lower depression 30. Tightening the screws 33 squeezes the beam between the hooks and screws, thus rigidly joining beam members 1 and 1'.

Reference numeral 34 indicates a pencil tray that may be removably inserted between the beams 3 in a gap between adjoining work surfaces, such as shown in FIG. 1.

Figure 8:
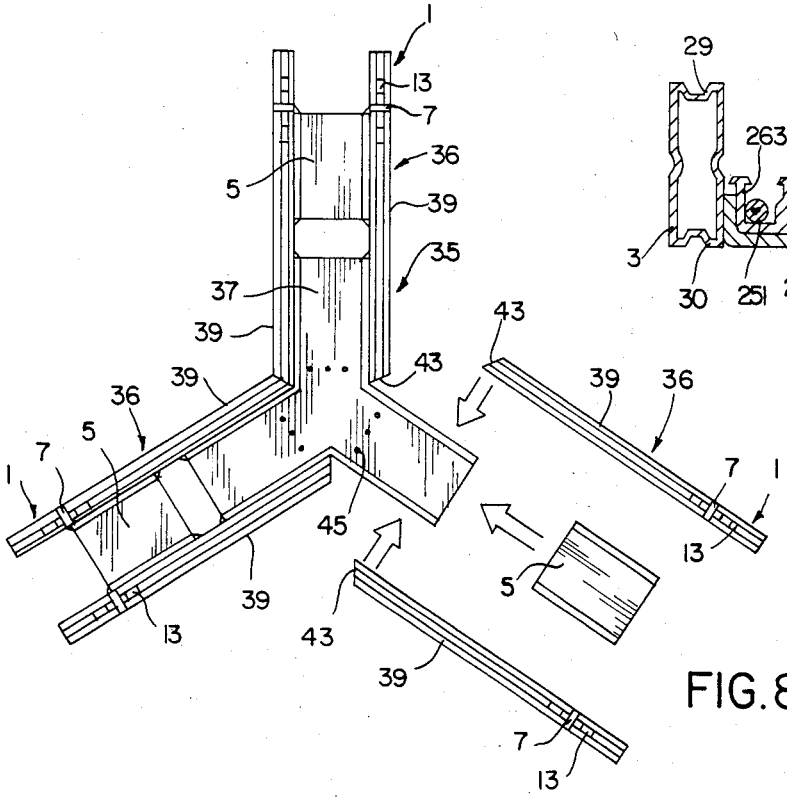
FIG. 8 is a top view of a lateral connection between three modular beam members.

FIG. 8 shows a lateral connector 35 for joining three beam members 1 that intersect at 120°. The connector includes three short beam members 36 and a three-legged plate 37 that is similar in vertical cross-section to U-shaped plate 5 (see FIG. 3). Each short beam member 36 is constructed by welding a plate 5 between two short sections 39 of standard beam configuration near one end of the sections. The other ends of the short beam sections are welded to the plate 37. To enable the short beam members 36 to interfit with one another in a neat fashion, the abutting ends are fabricated with bevels 43. The connection between the lateral connector 35 and beam members 1 are made as previously described, that is, by utilizing connectors 7 and keys 13 (see FIGS. 4 and 5).

It is contemplated that a vertical support 51 will normally be placed under the connector 35. To allow wires to pass from the vertical support to the beam members, as will be described fully hereinafter, openings 45 are provided in the plate. Although not described in detail herein, it will be apparent that a lateral connector for joining four beam members that intersect at 90° falls within the intent of the present invention.

Figure 14:
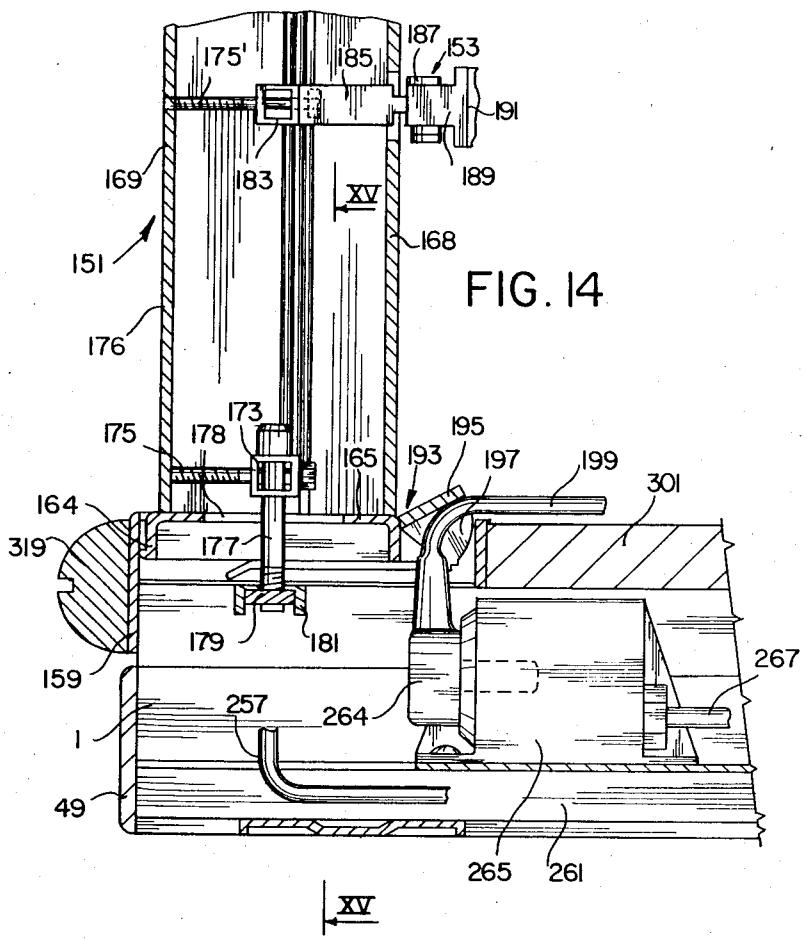
FIG. 14 is a sectional view taken along lines 14—14 of FIG. 2.

To enhance the appearance of the beam members 1, a resilient decorative cap 49, shown in FIG. 14, is snapped in place over the beam open ends 50, as seen in FIGS. 1 and 2.

Vertical Supports

Figure 9:
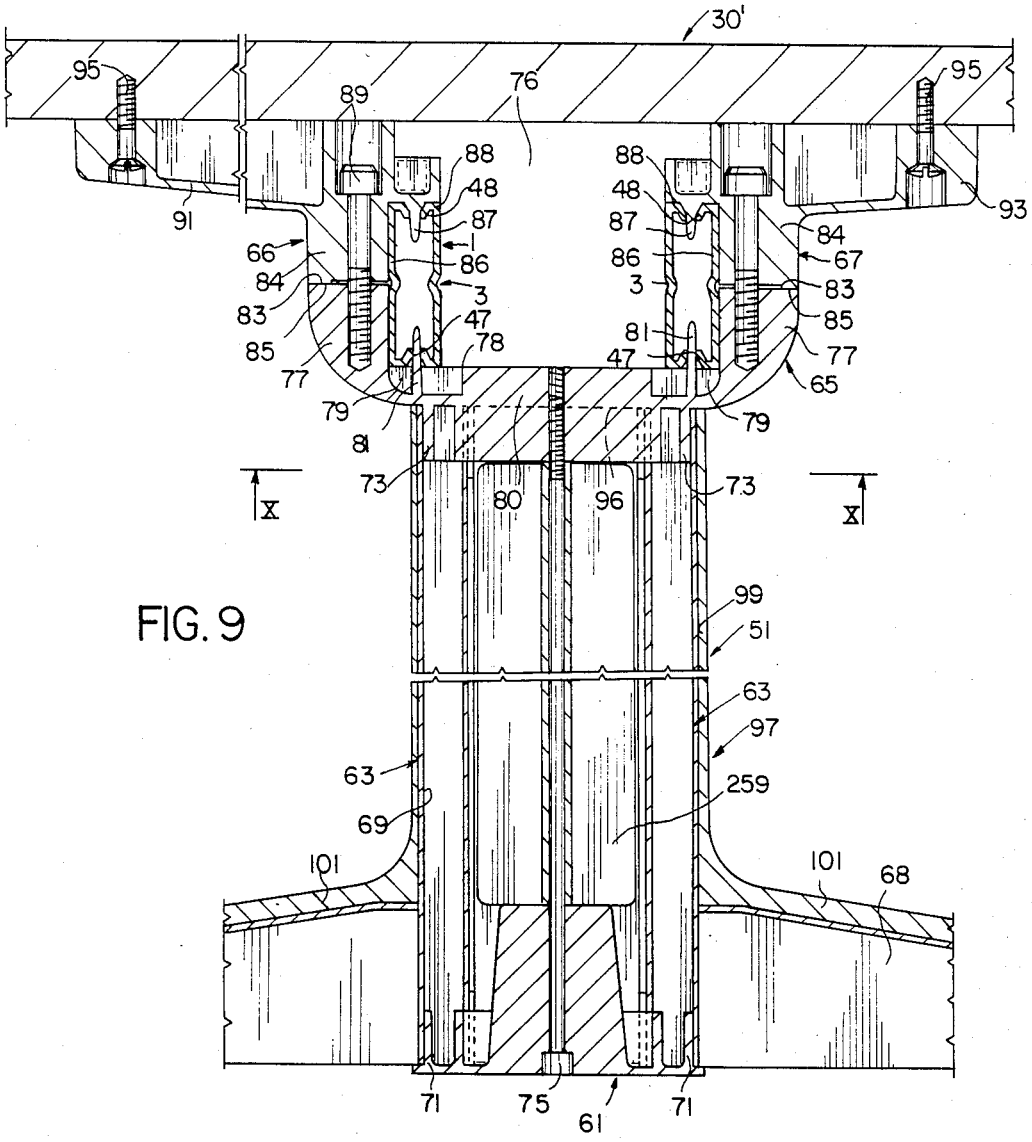
FIG. 9 is a sectional view through a typical combination of components comprising a vertical support of the present invention.
Figure 10:
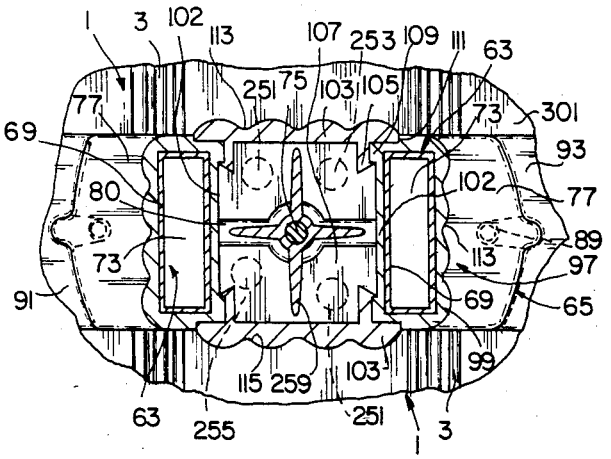
FIG. 10 is a sectional view taken along lines 10—10 of FIG. 9.

The construction of the vertical supports 51 for supporting the modular furniture of the present invention is illustrated in FIGS. 9 and 10. The structural members that bear the weight of the beams 1 and work surfaces 301 include a pedestal 61, two columns 63, a yoke 65, and two brackets 66 and 67. The vertical support may also be provided with one or more feet 68. The preferred material for the vertical support structural members is aluminum.

The column 63 is preferably constructed as a rectangular tube having relatively thin walls 69. The lower ends of the column walls fit snugly over upstanding rectangular projections 71 formed in the pedestal 61. The upper ends of the column walls fit snugly over downwardly extending rectangular projections 73 in yoke 65. To tie the yoke, pedestal and columns into a unitary structure, a long screw 75 extends between the pedestal and the yoke, the yoke having a threaded opening to receive the screw threads.

The yoke 65 includes a channel 76 defined by a pair of sides 77 and a floor 78. The sides 77 are joined by a strut 80 and have facing vertical surfaces 79 spaced apart a distance slightly greater than the spread between the outer vertical surfaces of beam member 1. Thus, the beam member rests on the floor 78 of strut 80 and fits rather loosely in channel 76. To rigidly locate the yoke longitudinally and laterally in the beam member, the yoke is constructed with two pairs of spaced vertical tabs 81 that project into corresponding spaced slots 47 in the bottom walls of beams 3; two tabs project into each beam. The slots 47 are similar to the slots 15 described previously for longitudinally joining two beam members; they are located at spaced intervals along the beams.

A flat horizontal surface 83 is machined on the upper end of each side 77. The surfaces 83 provide support for brackets 66 and 67 through corresponding lower surfaces 85 on the brackets. The brackets 66 and 67 are of substantially identical construction except for the length of wing portions 91 and 93, respectively; therefore, a description of one bracket will be considered sufficient. The surfaces 85 are machined on the bottoms of sides 84, which have vertical surfaces 86 that correspond with yoke vertical surfaces 79. To laterally and longitudinally position the brackets to beam member 1, each bracket has a pair of downwardly extending tabs 87 that project from upper horizontal surface 88 into corresponding spaced slots 48 in the top walls of beams 3. Screws 89 join the yoke and brackets together. Thus, the beam member is restrained vertically between upper surface 88 and floor 78, and it is restrained longitudinally and laterally by tabs 81. The brackets are restrained vertically by surfaces 83 and screws 89, and they are restrained longitudinally and laterally by tabs 87. Screws 95 attach the work surface 301 to the bracket.

The versatility of the modules allows a vertical support 51 to be located at the longitudinal junction of two beam members 1. To accomplish that, the yoke 65 and brackets 66 and 67 are used in place of connectors 7 and keys 13, FIGS. 4 and 5, for longitudinally joining two beam members in addition to vertically supporting the beam members.

If desired, the vertical supports 51 may include one or more feet 68. In the illustrated embodiment, the feet are manufactured as thin walled box-like structures, preferably of aluminum. If two feet are use, each is welded to a column 63 and thus serve the functional purpose of providing increased stability to the vertical support. If more than two feet are desired, two are welded to the column, and the additional feet are joined to pedestal 61 by a well known dovetail arrangement, not shown, for providing an attractive but non-functional appearance.

Because the present invention provides great flexibility in the placement of the vertical supports 51, the attachment of a work surface 301 to a beam member 1 is not limited to vertical support locations. Brackets 66 and 67 may be used with a modified yoke for supporting a work surface at points intermediate the vertical supports. The modified yoke is very similar to yoke 65, but the downward projections 73 are omitted, so that the lower contour of the yoke follows phantom line 96 of FIG. 9.

Further in accordance with the present invention, the modules are designed to be esthetically pleasing. In the preferred construction of the vertical supports 51, the structural members 63 and 68 are covered with two types of decorative sidings that greatly increase the attractiveness of the vertical supports. The first type of siding is a hollow columnar member 97 comprised of an upright section 99 and a foot section 101. The interior of the hollow upright section 99 is of a size and shape to fit over column 63, and foot section 101 fits over the top and sides of foot 68. Each interior wall 102 of the hollow section 99 terminates above and below, respectively, the projections 71 and 73 of pedestal 61 and yoke 65, respectively. The second type of decorative siding is relatively flat and extends the length of column 63; it is shown at reference numeral 103, FIG. 10. The siding 103 includes hooks 105 protruding into the interior 107 of the vertical support. The hooks 105 flexibly latch onto shoulders 109 formed on the interior sides of hollow siding 97. To further enhance the appearance of the vertical supports, the sidings 103 are recessed into steps 111 of the sidings 97 and corresponding steps in the yoke 65. If three or four feet are desired, the non-functional feet are encased in a decorative siding similar to foot section 101. Siding 103 is then modified to terminate at the upper surface of the non-functional foot siding section.

Merely by way of illustration, the decorative exterior surfaces of sidings 97 and 103 may be in the form of flutes 113. The preferred material for the decorative sidings is a strong but flexible plastic.

Work Surfaces

Figure 13:
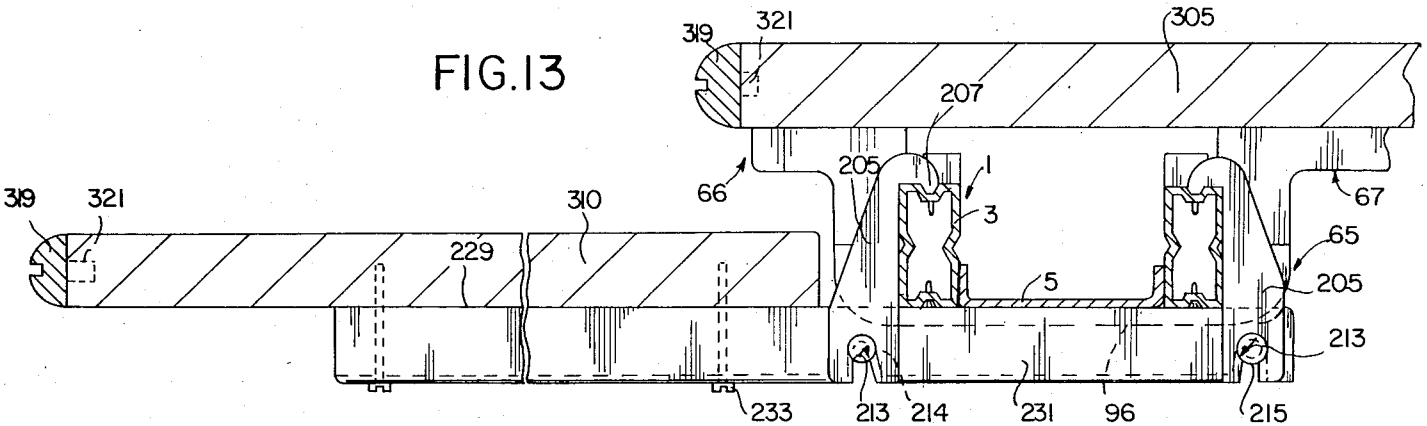
FIG. 13 is a sectional view taken along lines 13—13 of FIG. 1.

To serve both functional and environmental purposes, the work surfaces 301 can be of a wide variety of sizes and shapes, as best shown in FIGS. 1 and 2. All work surfaces, however, are mounted to the beam members 1 by yoke 65 or a modified yoke and by brackets 66 and 67, as previously described and as illustrated in FIGS. 9 and 10. The work surfaces are manufactured from attractive and functional materials, including smoked glass, wood, and plastic laminate. A particularly attractive work surface is composed of a plastic laminate with a removable decorative half-round wood edging 319 that fastens to the work surface edges by means of dowels 321 and corresponding holes, as illustrated in FIG. 13.

Filing Cabinets

Figure 12:
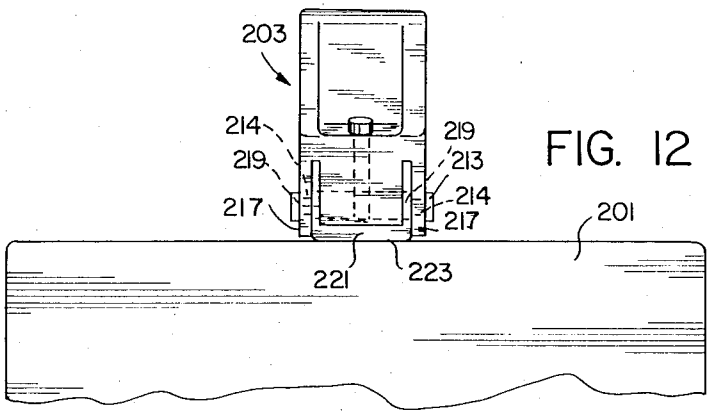
FIG. 12 is a view taken along lines 12—12 of FIG. 11.
Figure 11:
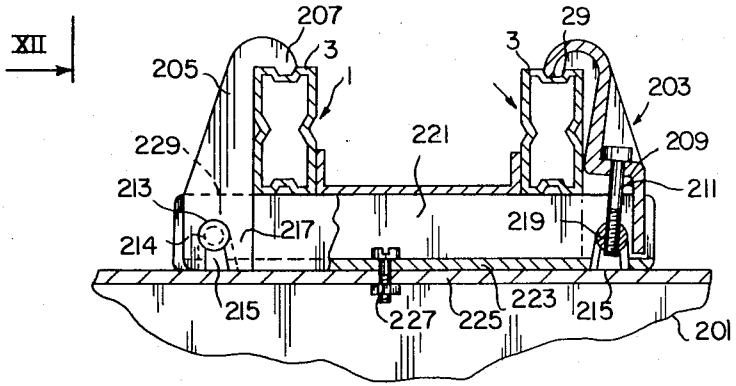
FIG. 11 is a sectional view taken along lines 11—11 of FIG. 1.

The beam members 1 are sufficiently strong and stiff to support file cabinet 201 suspended therefrom, FIGS. 1 and 2. The suspension mechanism 203 is best illustrated in FIGS. 11 and 12. Each beam 3 supports a suspension member 205 having a hook 207 at the upper end thereof. The suspension member is constructed with a ledge 209 having a generally vertical opening therein for receiving screw 211. The head of the screw bears against the ledge. The screw threads engage a transverse threaded opening in a pin 213 having grooves 214 that are received in clearance slots 215 in spaced apart legs 217 of the suspension member. The pin 213 is also received in openings 219 in the vertical walls of a channel 221. The bottom wall 223 of the channel is fastened to the top wall 225 of cabinet 201 by conventional fasteners such as screw and nut 227.

To suspend the file cabinet 201 from the beam member 1, the cabinet is fastened to the channel 221. Pins 213 are inserted through the channel openings 219. Hooks 207 are placed in the top depressions 29 of beams 3. The cabinet is raised by any convenient method to within a short distance of the underside of the beam member 1 so that the slots 215 of suspension member 205 are placed over the pin grooves 214. A screw 211 is then inserted through the opening in ledge 209 of each suspension member to engage the threads in the corresponding pin. Tightening the screws draws the channel and cabinet upward until the top surface 229 of the channel contacts the underside of the beam member. At that point, further tightening of the screws will rigidly join the suspension mechanism to the beam member.

The cabinet may be easily relocated to another location along the beam member by loosening screws 211 a slight amount and sliding the cabinet and suspension mechanism along the beam member to the new location. Retightening the screws will again rigidly join the cabinet to the beam member.

A slight modification to the suspension mechanism 203 of FIGS. 11 and 12 enables the beam member 1 to suspend a keyboard surface 310 therefrom. As shown in FIGS. 1 and 2, the keyboard surface is used in conjunction with a keyboard work surface 305. The versatility of the modules of the present invention permits horizontal placement of the keyboard surface at almost any desired relationship to the keyboard work surface. Referring to FIG. 13, the beam member 1 is shown with suspension members 205, pins 213, and an elongated channel 231. The channel 231 extends substantially beyond the beam member to support keyboard surface 310 which is secured at the desired location by conventional fasteners 233. The keyboard work surface is indicated at 305, together with decorative edging 319. Also shown in FIG. 13 are brackets 66 and 67 and the modified yoke described previously in conjunction with the mounting of the beam member on vertical supports 51 (see FIGS. 9 and 10).

Service Modules

As shown in FIGS. 1 and 2, some work surfaces 301 contain openings that are adapted to receive small upstanding service modules. For example, in FIG. 1, a light module 151 is mounted in one of the keyboard work surfaces 305. In FIG. 2, light module 151 is mounted in rectangular work surface 303; the light module includes a swingable telephone tray 153. Other modules, all with interchangeable connections to the work surfaces, include telephone trays and work baskets. As a further example of the versatility of the modules, a light module may contain a radio and/or a clock.

Figure 15:
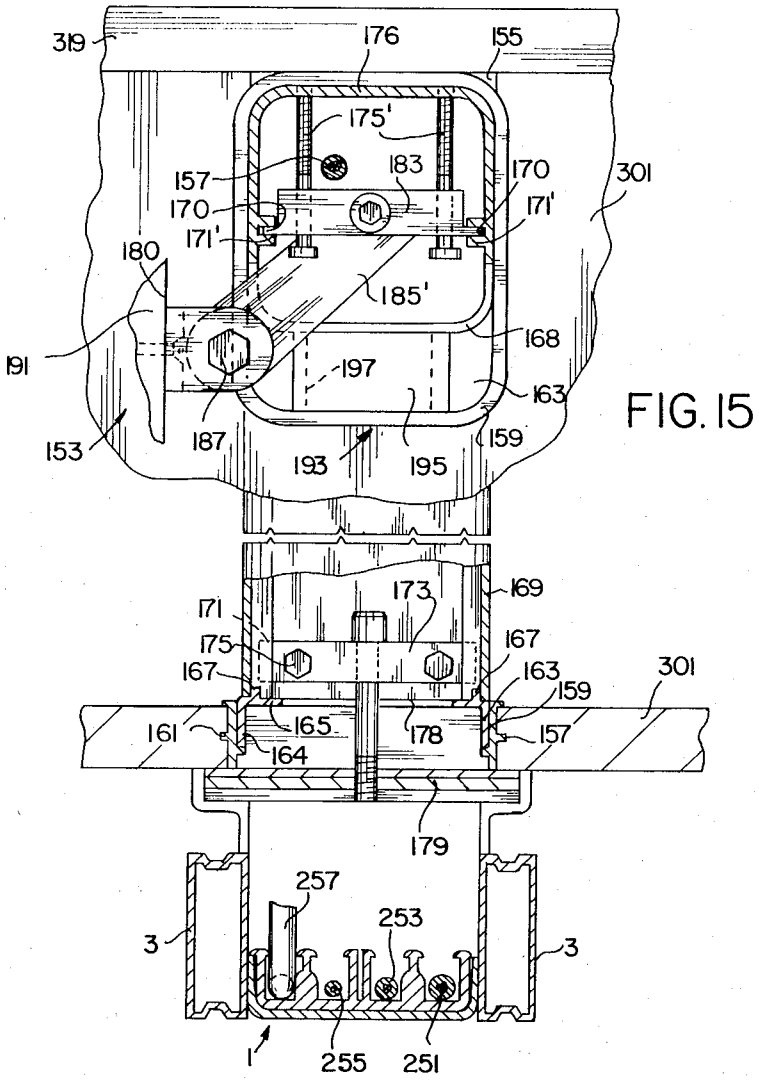
FIG. 15 is a sectional view taken along lines 15—15 of FIG. 14.

Turning to FIGS. 14–15, the apparatus for mounting the light module 151 is shown in detail. It will be understood that the light module is merely exemplary; other upstanding modules employ the same apparatus.

As shown in FIGS. 14–15, a notch 155 is cut into the work surface 301 from one end. The notch is grooved along opposite sides at 157, FIG. 15. A thin-walled four-sided shell 159, having tongues 161 corresponding to grooves 157, is pushed into the notch before the decorative edging 319 is applied. A column base 163 having four vertical sides 164 and a top wall 165 is resiliently pressed into the shell 159. The wall 165 includes tw parallel ridges 167 extending upwardly from the top surface thereof. Column 169 of the module 151 is fabricated as a three-sided thin-walled member that locates over ridges 167. The open side of column 169 is covered with a snap-on cover 168. The interior of the two opposite walls of column 169 are fabricated with opposed grooves 170, FIG. 15, for receiving ears 171 of a rectangular tube 173. The height of tube 173 may be adjusted within the column. The tube contains a pair of threaded holes for receiving screws 175. Turning screws 175 against the back wall 176 of the column locks the tube to the column. To anchor the column in place on the column base, a screw 177 is inserted vertically through the tube and through an opening 178 in wall 165 and is threaded into a threaded bar 179 captured in a channel 181. The bar 179 and channel 181 span the notch 155 in the work surface 301, FIG. 14.

To aid combining functionality with a pleasing environment, the column 169 may support a telephone module 153 or other productivity enhancing devices. As shown in FIGS. 14 and 15, the module 153 is adjustably mounted to the column 169 by tube 183 having ears 171' that slide in grooves 170. Tightening screws 175' locks the tube 183 to the column at the desired height. The tube includes a lug 185 projecting therefrom that pivotally supports, such as by a shoulder screw and nut 187, a clevice 189. The clevice may be configured to mount a receptacle 191 for commonly used office items, such as telephones and papers.

If a service module is not desired, the notches 155 are covered with decorative cover plates 309, FIGS. 1 and 2. The cover plates are very similar to the column base 163, but they lack the ridges 167 and opening 178. The cover plates may be provided with a decorative hinged cover 193 if passage of wires through the cover plate is desired, as will be explained hereinafter.

In keeping with the esthetic qualities of the present invention, the cover 168, column 169, column base 163, hinged cover 193, and cover plate 309 are of the same color plastic material as the decorative sidings 97 and 103 of the vertical supports. Moreover, the surface textures, as for example, the flutes 113 shown in conjunction with the sidings 97 and 103 of FIG. 10, are similarly incorporated into the light module components 168, 169, 163, 193, and 309.

Wire Management

Pursuant to the present invention, provision is made for the neat and efficient management of the electrical and control wiring used in connection with the office furniture. This is accomplished by hiding the wiring within the furniture modules while supplying them to the required location.

In the preferred construction, wiring from the office outlets enter the modular furniture assembly of the present invention through an opening in a vertical support 51. For example, the wiring may enter vertical support 53 in FIG. 1 through an opening 115 in the lower end of decorative siding 103, FIG. 10. To aid in separating the wires 251, 253, 255, and 257 within the vertical support, a plastic four-lobed wire divider 259 is employed. Separation of wires is important if, for example, wires for 120 volt A.C. power and for computer data transmission are required at the furniture assembly. The wire divider 259 has a hollow central opening to receive the vertical support tie screw 75. The wires pass beside strut 80 of yoke 65 to enter channel 76, FIG. 9, and thence along the beam members 1.

Turning once again to FIG. 3, plastic wire tray 261 is shown carried by the plates 5 of beam members 1. The wire tray illustrated contains four ducts 263 that are open at the top. Since the work surfaces 301 are normally the last modules assembled, the wires 251, 253, 255, and 257 may be easily installed in the wire trays from above, thus eliminating the necessity of pulling the wires through closed conduits.

In FIG. 14, wire 257 may be a power wire for the lamp 200 of light module 151 (see FIGS. 1 and 2). Wire 257 runs from tray 261 through the work surface notch 155, passes through column base opening 178, and rises to the conventional terminals, not illustrated of the lamp 200. Similar wiring configurations are used for radio, clock, and telephone services.

Besides supporting column 169, the column base 163 also serves as a convenient and attractive means for passing wires from the beam member to the point of use on the work surface. For that purpose, a three-sided hinged cover 193 pivots within the column base about a horizontal axis by means of pins and holes of well-known construction, not shown in FIGS. 14 and 16. The cover 193 comprises a decorative lid 195 and two sides 197. Thus, cover 193 may be opened sufficiently to pass a wire, as at 199, from the beam member 1 to the top of work surface 301. If no wire is present, the cover is closed so the lid 195 is flush with the column base and work surface.

Many office electrical appliances, as for example, typewriters, are provided with a male plug 264 on the end of an electrical cord, as at 199. To provide power for the appliances in a neat and convenient fashion, a conventional socket 265, FIG. 14, may be installed on top of tray 261 within the beam member 1. The use of an extensible cord 267 allows the same socket module to be employed for all work surfaces 301. The extensible cord leads to a common junction, now shown, located within the beam member near the vertical support that receives the wires from the office outlets.

Thus, it is apparent that there has been provided, in accordance with the invention, modular office furniture with integrated wire management that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. Modular apparatus for combining into functional and esthetically pleasing office work stations and for managing electrical wires comprising:

(a) a plurality of generally horizontal beam members, each beam member including at least one plate interposed between and rigidly joined to a pair of laterally spaced substantially parallel beams;

(b) a plurality of connecting means for longitudinally rigidly connecting the respective beams of adjoining beam members into a selected overall length to suit an office space;

(c) at least two vertical support means for rigidly supporting the beam members at selected locations thereon;

(d) at least one work surface; and (e) bracket means for rigidly mounting the work surface to the beam members at selected locations thereon, so that the work surface and vertical support means may be rigidly connected to the beam members at selected locations thereon to create a great number of patterns to suit the office work and personnel requirements and wherein the beams are fabricated as generally rectangular tubes having top and bottom walls, each top and bottom wall being formed with a longitudinal depression in the exterior thereof, each top and bottom wall defining a plurality of aligned longitudinally spaced slots, the depressions and slots being adapted to receive and cooperate with the bracket means for rigidly mounting the work surface to the beam members.

2. Modular apparatus for combining into functional and esthetically pleasing office work stations and for managing electrical wires comprising:

(a) a plurality of generally horizontal beam members, each beam member including at least one plate interposed between and joined to a pair of laterally spaced substantially parallel beams, the beams being fabricated as generally rectangular tubes having top and bottom walls, each top and bottom wall being formed with a longitudinal depression in the exterior thereof, each top and bottom wall defining a plurality of aligned longitudinally spaced slots;

(b) a plurality of connecting means for longitudinally rigidly connecting adjoining beam members into a selected overall length to suit an office space, wherein each longitudinal connecting means comprises a connector having a base with a pair of tongues extending oppositely therefrom for inserting into the ends of the beams to be joined, each tongue defining a transverse slot therethrough that is aligned with a slot in the top and bottom walls of the beams to be joined when the tongues are fully inserted into the respective beams, and a pair of keys for inserting into the aligned tongue and beam slots to rigidly lock the adjoining beams to the connecting means;

(c) at least two vertical support means for rigidly supporting the beam members at selected locations thereon;

(d) at least one a work surface; and (e) bracket means for rigidly mounting the work surface to the beam members at selected locations thereon, so that the work surface and vertical support means may be rigidly connected to the beam members at selected locations thereon to create a great number of patterns to suit the office work and personnel requirements.

3. Modular apparatus for combining into functional and esthetically pleasing office work stations and for managing electrical wires comprising:

(a) a plurality of generally horizontal beam members, each beam member including at least one plate interposed between and joined to a pair of laterally spaced substantially parallel beams, the beams being fabricated as generally rectangular tubes having top and bottom walls, each top and bottom wall being formed with a longitudinal depression in the exterior thereof, each top and bottom wall defining a plurality of aligned longitudinally spaced slots, and wherein the beam members further comprise a lateral connector for connecting a first beam member to a second beam member at substantially right angles, the lateral connector comprising:

(i) an angle clamp having a tongue for inserting into the end of the first beam, the tongue defining a transverse slot therethrough that is aligned with the slots in the top and bottom walls of the first beam when the tongue is fully inserted into the first beam, and jaw means for clamping the top and bottom walls of the beam; and (ii) a key for inserting into the aligned tongue and first beam slots to rigidly lock the angle clamp to the first beam;

(b) a plurality of connecting means for longitudinally rigidly connecting adjoining beam members into a selected overall length to suit an office space;

(c) at leat two vertical support means for rigidly supporting the beam members at selected locations thereon;

(d) at least one work surface; and (e) bracket means for rigidly mounting the work surface to the beam members at selected locations thereon, so that the work surface and vertical support means may be rigidly connected to the beam members at selected locations thereon to create a great number of patterns to suit the office work and personnel requirements.

4. Modular apparatus for combining into functional and esthetically pleasing office work stations and for managing electrical wires comprising:

(a) a plurality of generally horizontal beam members, each beam member including at least one plate interposed between and joined to a pair of laterally spaced substantially parallel beams, the beams being fabricated as generally rectangular tubes having top and bottom walls, each top and bottom wall being formed with a longitudinal depression in the exterior thereof, each top and bottom wall defining a plurality of aligned longitudinally spaced slots, and wherein the beam members further comprise an angular connector for longitudinally connecting at least three beam members to each other, the angular connector comprising a plate having at least three legs, each leg being interposed between and joined to a pair of substantially parallel beams laterally spaced apart to align with the laterally spaced beams of a beam member, so that three beam members may be longitudinally joined to each other;

(b) a plurality of connecting means for longitudinally rigidly connecting adjoining beam members into a selected overall length to suit an office space;

(c) at least two vertical support means for rigidly supporting the beam members at selected locations thereon;

(d) at least one work surface; and (e) bracket means for rigidly mounting the work surface to the beam members at selected locations thereon, so that the work surface and vertical support means may be rigidly connected to the beam members at selected locations thereon to create a great number of patterns to suit the office work and personnel requirements.

5. Modular apparatus for combining into functional and esthetically pleasing office work stations and for managing electrical wires comprising:

(a) a plurality of generally horizontal beam members, each beam member including at least one plate interposed between and joined to a pair of laterally spaced substantially parallel beams;

(b) a plurality of connecting means for longitudinally rigidly connecting adjoining beam members into a selected overall length to suit an office space;

(c) at least two vertical support means for rigidly supporting the beam members at selected locations thereon, wherein each vertical support means comprises:

(i) a pedestal having a pair of spaced upstanding rectangular shaped projections;

(ii) a pair of rectangular tubes guided by and upstanding from the pedestal projections for supporting the work surface at the proper height above the office floor;

(iii) a yoke having a pair of rectangular shaped projections depending therefrom and adapted to receive the rectangular tubes to vertically, laterally, and longitudinally restrain the beam member; and (iv) bracket means supported by the yoke for supporting and for longitudinally and laterally restraining the work surface;

(d) at least one work surface; and (e) bracket means for rigidly mounting the work surface to the beam members at selected locations thereon, so that the work surface and vertical support means may be rigidly connected to the beam members at selected locations thereon to create a great number of patterns to suit the office work and personnel requirements.

6. The modular apparatus of claim 5 wherein the vertical support means further comprises:

(a) a pair of elongated hollow decorative sidings, each siding encasing a rectangular tube and extending vertically from the pedestal to the yoke, each hollow siding having a shoulder extending along each vertical edge; and (b) a pair of generally flat decorative sidings, each flat siding having hook means extending therefrom for detachably fastening to a corresponding shoulder of each hollow decorative siding, so that the hollow and flat sidings cooperate to form an enclosed vertical passageway through the vertical support means.

7. The modular apparatus of claim 5 wherein the yoke and the bracket means includes tab means for inserting into the slots in the bottom and top walls, respectively, of the beams to provide longitudinal and lateral restraint of the beam member and work surface.

8. Modular apparatus for combining into functional and esthetically pleasing office work stations and for managing electrical wires comprising:

(a) a plurality of generally horizontal beam members, each beam member including at least one plate interposed between and joined to a pair of laterally spaced substantially parallel beams, the beams being fabricated as generally rectangular tubes having top and bottom walls, each top and bottom wall being formed with a longitudinal depression in the xterior thereof, each top and bottom wall defining a plurality of aligned longitudinally spaced slots, and wherein the beam members further comprise:

(i) a pair of suspension members, each having a hook for inserting into the depression in the top wall of a beam at a selected location therealong and a ledge having a generally vertical aperture therethrough;

(ii) two pins, each pin having a threaded transverse opening therethrough;

(iii) screw means for inserting through each suspension member ledge aperture and threaded into a pin;

(iv) a work station module; and (v) channel means for fastening to the work station module and for receiving the pins to suspend the channel means and work station module from the pins, so that the work station module may be suspended from the beam members at selected locations thereon;

(b) a plurality of connecting means for longitudinally rigidly connecting adjoining beam members into a selected overall length to suit an office space;

(c) at least two vertical support means for rigidly supporting the beam members at selected locations thereon;

(d) at least one work surface; and (e) bracket means for rigidly mounting the work surface to the beam members at selected locations thereon, so that the work surface and vertical support means may be rigidly connected to the beam members at selected locations thereon to create a great number of patterns to suit the office work and personnel requirements.

9. The modular apparatus of claim 8 wherein the work station module is a work surface, and wherein the channel means is adpated to support the work surface.

10. The modular apparatus of claim 8 wherein the work station module is a file cabinet, and wherein the channel means is adapted to fasten to the top wall of the file cabinet.

11. Modular apparatus for combining into functional and esthetically pleasing office work stations and for managing electrical wires comprising:

(a) a plurality of generally horizontal beam nembers, each beam member including at least one plate interposed between and joined to a pair of laterally spaced substantially parallel beams;

(b) a plurality of connecting means for longitudinally rigidly connecting adjoining beam members into a selected overall length to suit an office space;

(c) at least two vertical support means for rigidly supporting the beam members at selected locations thereon;

(d) at least one work surface, wherein the work surface includes shell means for alternatively receiving a selected service module and a cover plate module; and (e) bracket means for rigidly mounting the work surface to the beam members at selected locations thereon, so that the work surface and vertical support means may be rigidly connected to the beam members at selected locations thereon to create a great number of patterns to suit the office work and personnel requirements.

12. The modular apparatus of claim 11 wherein the service module comprises:

(a) upstanding column means for supporting at least one selected office service above the work surface;

(b) column base means resiliently pressed into the shell means for guiding and supporting the column means; and (c) mounting means for anchoring the column means to the column base.

13. The modular apparatus of claim 12 wherein the service module includes an electric light.

14. The modular apparatus of claim 12 wherein the service module includes vertically adjustable swingable means for holding selected office equipment.

15. The modular apparatus of claim 12 wherein the column base means includes a hinged cover adapted to alternatively open to allow a wire to pass through the column base means and work surface and to close to a position flush with the column base means and work surface when no wire passes therethrough.

16. The modular apparatus of claim 11 wherein the cover plate module includes a hinged cover adapted to alternatively open to allow a wire to pass through the cover plate module and to close to a position flush with the cover plate and work surface when wire passes therethrough.

17. The modular apparatus of claim 1 further comprising a plurality of longitudinally joined upwardly open wire trays carried by the beam members and covered by the work surface to separate the wires while allowing unobstructed installation of the wires from above.

* * * * *